US005328086A

United States Patent [19]

Hall, Jr.

[11] Patent Number: 5,328,086

[45] Date of Patent: Jul. 12, 1994

[54] MECHANISM AND METHOD FOR REMOVING TWISTS IN A TUBE FORMING MACHINE

[75] Inventor: Bertie F. Hall, Jr., Ann Arbor, Mich.

[73] Assignee: Hoskins Manufacturing Co., Detroit, Mich.

[21] Appl. No.: 110,092

[22] Filed: Aug. 20, 1993

[51] Int. Cl.[5] ..... B21C 37/04

[52] U.S. Cl. ..... 228/146; 219/61.3; 228/17.5

[58] Field of Search ..... 228/17.5, 146, 147; 219/61.3

[56] References Cited

U.S. PATENT DOCUMENTS 3,784,081 1/1974 Karmann et al. ..... 219/61.3

*Primary Examiner*—Kenneth J. Ramsey

*Attorney, Agent, or Firm*—Brooks & Kushman

[57] ABSTRACT

A mechanism and method for counteracting and removing the twist of a rolled metal strip being formed into a tube by a tube forming machine. The mechanism has a frame rotatably mounted to the tube forming machine between the forming rolls and the seam guide. A pair of edge rolls are attached to the frame and are engageable with the opposing longitudinal edges of the rolled metal strip. Backing rolls, also attached to the frame, inhibit the transverse displacement of the rolled metal strip by the engagement of the edge rolls with the longitudinal edges of the metal strip. An adjustment screw rotates the frame relative to the tube forming machine about a longitudinal axis to align the longitudinal edges of the rolled metal strip with a seam guide prior to welding the longitudinal edges to each other.

20 Claims, 1 Drawing Sheet

MECHANISM AND METHOD FOR REMOVING TWISTS IN A TUBE FORMING MACHINE

TECHNICAL FIELD

The invention is related to the field of machines for making seam welded tubing from flat metal strips and, in particular, to a mechanism for counteracting and removing undesirable twists in the metal strip as it is being formed into a tubular shape to assist in alignment with and to prevent the edges of the metal strip from being deformed by the seam guide.

BACKGROUND ART

In the formation of seam welded tubing, a seam guide, as taught by Crawford in U.S. Pat. No. 2,936,357 and Hellman, Sr. in U.S. Pat. No. 4,905,885, is used to align the seam to be welded with the welder. However, due to imperfections in the metal strip, the formation of the seam by the preceding forming rolls will not be aligned with the seam guide. As a result, one edge or the other of the seam being formed may engage the edge of the seam guide with enough force to cause that edge to be galled or otherwise deformed and fail to maintain alignment under the welder. This deformation of an edge of the metal strip often results in defects in the welded seam and the misalignment can cause the strip edges to be welded out of registry. As a result, the tube forming process must be closely monitored and the tube fabrication process be stopped when a twist in the seam being formed is detected.

Attempts to solve this problem are taught by Crawford in U.S. Pat. No. 2,936,357, Kato et al, U.S. Pat. No. 4,299,708 and by Nakako in Japanese Application 99224. All three disclose a rolling seam guide in the form of an annular fin. Kato et al. and Nakako teach that the annular fin is provided on the internal surface of one or more of roll just prior to welding. These rolls serve as tube forming rolls and seam guides.

Although these rolling seam guides reduce the galling and deformation of the edges forming the seam, problems are still encountered. The invention is a mechanism for removing the twist in the metal strip as it is being shaped into a tubular form which substantially eliminates the galling and deformation of the edges as they are being guided by the seam guide and effectively assures that the edges of the metal strip are not misaligned when welded.

SUMMARY OF THE INVENTION

The invention is a mechanism and method for counteracting and removing a twist in a rolled metal strip being formed into a tube by a tube forming machine. The mechanism has a mounting bracket mountable to the tube forming machine and a frame rotatably attached to the mounting bracket. The frame is rotatable about a longitudinal axis concentric with the axis of the rolled metal strip. At least one pair of edge rolls are attached to the frame. Each of the edge rolls is rollingly engageable with a respective one of the longitudinal edges of the rolled metal strip. At least one pair of backing rolls are also attached to the frame. The pair of backing rolls is engageable with the side of the rolled metal strip opposite the side engaged by the edge engaging rolls. The pair of backing rolls inhibit the transverse displacement of the rolled metal strip by the pair of edge rolls. Means are provided to rotate the rotatable frame about its longitudinal axis to align the longitudinal edges of the rolled metal strip with a seam guide. This alignment of the edges of the metal strip with the seam guide prevents galling or deformation of the longitudinal edges by the seam guide when a twist occurs in the rolled metal strip.

One advantage of the twist counteracting mechanism is that it prevents deformation of the edges of the metal strip when a twist occurs. This results in a more uniform welded seam.

Another advantage is that the twist counteracting mechanism provides a rolling engagement with the longitudinal edges of the rolled metal strip, thereby reducing galling of the longitudinal edges.

Still another advantage is that the twist counteracting mechanism may be adjusted without stopping the tube forming mechanism.

These and other advantages will become more apparent from a reading of the detailed description of the invention in conjunction with the drawings.

DETAILED DESCRIPTION OF THE PREFERRED EMBODIMENT

Figure 1:
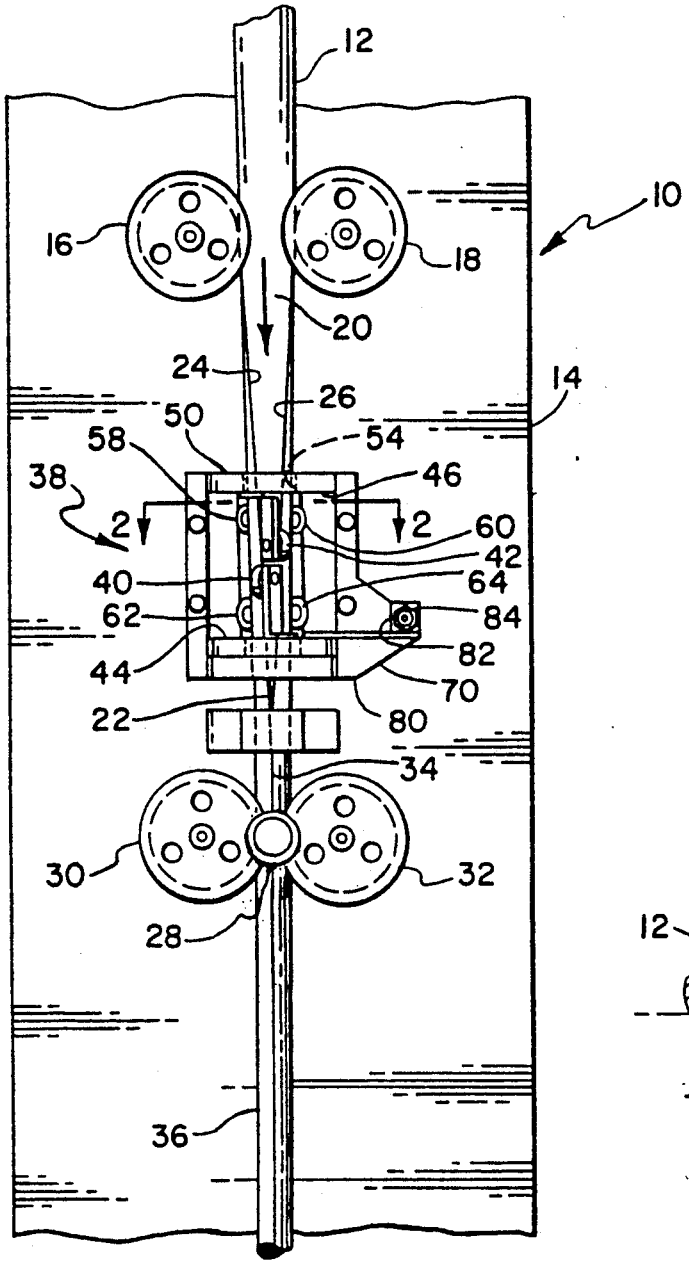
FIG. 1 is a partial front view of a tube forming machine including a twist counteracting mechanism.

FIG. 1 shows the main components of a machine 10 for continuously producing seam welded tubing from a flat metal strip 12. The machine 10 has a machine frame 14 which may be oriented in a vertical direction, as shown, or may be horizontally oriented as is known in the art. At least one set of forming rolls, illustrated by rolls 16 and 18, are rotatably mounted on the machine frame 14 and roll the flat strip 12 into a cylindrical form as it passes through the machine in the direction indicated by arrow 20. As is known in the art, the flat metal strip 12 is supplied to the machine 10 as a continuous metal strip from a spool, not shown. Although only two forming rolls, rolls 16 and 18 are shown, it is understood by those skilled in the art, that more than one set of forming rolls are normally required to roll the flat metal strip into a cylindrical or tubular form.

The machine 10 preferably has a seam guide 22 which aligns the edges 24 and 26 of the rolled metal strip with a welder 28. A final set of closing rolls, such as rolls 30 and 32, close the seam 34 formed by the edges 24 and 26 of the metal strip 12 just prior to being welded to each other by the welder 28. The welder 28 welds the edges 24 and 26 to each other to continuously produce seam welded tube 36.

Figure 3:
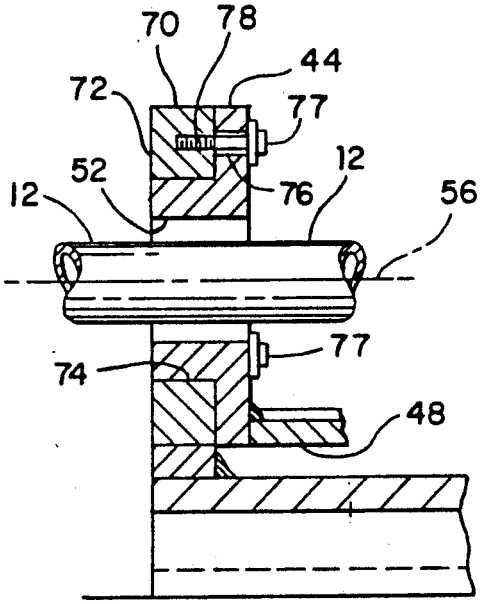
FIG. 3 is a partial cross-sectional view showing the details of how a frame is rotatably mounted to a mounting bracket.

A twist counteracting and removing mechanism 38 is mounted to the machine frame 14 between the seam guide 22 and the set of forming rolls 16 and 18. As shown more clearly in FIGS. 2 and 3, the twist removing mechanisms 38 has at least one pair of edge rolls 40 and 42 which rollingly engage the edges 24 and 26 of the metal strip 12 as it is being formed and align them with the seam guide 22. It is recognized that a duplicate pair of edge rolls 40 and 42 may be used if necessary or desired to increase the effectiveness of the twist counteracting mechanism. The edge rolls 40 and 42 engage the edges 24 and 26 in a direction substantially parallel to the edge surfaces. The edge roll 40 is attached to a first annular end member 44 while edge roll 42 is attached to a second annular end member 46 which is longitudinally spaced from the first annular end member 44. The annular end members 44 and 46 are rigidly connected to each other by a bridge member 48 to form a rotatable frame 50 (FIG. 1). The bridge member 48 may be a flat plate, but preferably is a curved plate as shown substantially mating with the outside diameters of the first and second end members 44 and 46. The annular end members 44 and 46 have axially aligned through apertures 52 and 54 respectively through which the rolled metal strip 12 passes, as shown. The axes of the axially aligned through apertures 52 and 54 define a longitudinal axis 56 which is concentric with axis of the tube 36 as it is being formed by the machine.

A first pair of backing rolls 58 and 60 are provided upstream of the edge rolls 40 and 42, while a second pair of backing rolls 62 and 64 are provided downstream of edge rolls 40 and 42. The backing rolls 58–64 are disposed on the side of the rolled metal strip 12 opposite the edge rolls 40 and 42 and support the rolled metal strip 12 concentric with the axes of through apertures 52 and 54. The backing rolls 58–64 engage the rolled metal strip and prevent it from being transversely displaced or from being misaligned by the forces applied to the edges 24 and 26 by edge rolls 40 and 42. Preferably, backing rolls 58 and 60 and backing rolls 62 and 64 are disposed at 90° relative to each other and are equally spaced on opposite sides of a plane defined by the seam 32 and the longitudinal axis of the tube 36 being formed. The rolls 58–64 may be attached to the bridge member 48, or they may be attached to respective annular end members 44 and 46.

Although two sets of backing rolls, such as backing rolls 58 and 60 and backing rolls 62 and 64 are preferred, it is recognized that a single set of backing rolls may be used. In this arrangement, backing rolls may be located intermediate the edge rolls 40 and 42.

Figure 2:
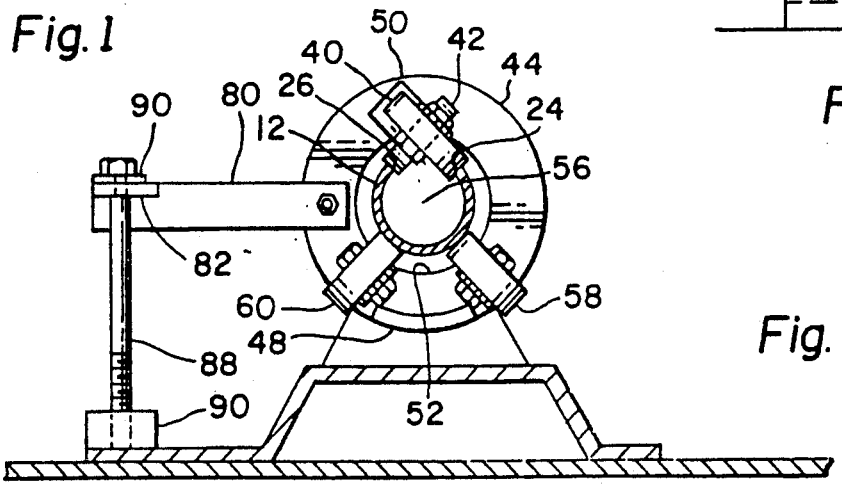
FIG. 2 is a cross-sectional view taken along section line 2—2 in FIG. 1.

The rotatable frame 50 is rotatably mounted to the machine frame 14 by a mounting bracket 70 (FIG. 2). The mounting bracket 70 is attached to the machine frame 14 and supports the rotatable frame 50 so that the longitudinal axis 56 of the through apertures 52 and 54 is concentric with the longitudinal axis of the tube 36 as it is being formed. The first annular end member 44 has an annular boss 72 which is concentric with the longitudinal axis 56. The annular boss 72 is rotatably received in a guide aperture 74 provided in mounting bracket 70. The first annular end member 44 has three equally spaced arcuate slots such as arcuate slot 76. Fasteners such as bolts 77 (FIG. 3), pass through the arcuate slots 76 and are received in threaded bores such as threaded bore 78 provided in the mounting bracket 70 to rotatably secure the rotatable frame 50 to the mounting bracket 70. The arcuate slots permit limited rotation of the rotating frame 50 relative to the mounting bracket 70.

An arm 80 (FIG. 2) is attached to the first annular member 44 and extends radially therefrom substantially parallel to the surface of the machine frame 14.

Figure 4:
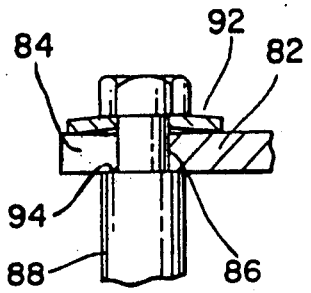
FIG. 4 is a partial cross-section showing a connection between an adjustment screw and a tab at the end of a radial arm.

The arm 80 has a tab 82 provided at its free end. The tab 82 has an open ended slot 84 which receives a necked down portion 86 of an angle adjustment screw 88 as shown in FIG. 4. The adjustment screw 88 is threadably received in a threaded bore provided in a screw block 90 attached to the mounting bracket 70. A spring washer 92 maintains the tab 82 of arm 80 against the shoulder 94 formed by the necked down portion 86 of adjustment screw 88.

The angular orientation of the rotatable frame 50 relative to the machine frame 14 and the edge rolls 40 and 42 relative to the edges 24 and 26 of the tube being formed may be adjusted by rotating adjustment screw 88 in either a clockwise or counterclockwise direction as required.

In operation, the edge rolls 40 and 42 engage the edges 24 and 26 of the rolled metal strip 12 at a location immediately prior to being aligned with the welder 28 by the seam guide 22. The operator will observe the edges 24 and 26 as they pass the seam guide 22. If a gap exists between seam guide 22 and one of the edges 24 or 26 or if the gaps between the seam guide 22 and the edges 24 and 26 are unequal due to a twisting of the metal strip 12 as it is being formed, the rotatable frame 50 and the attached edge rolls are rotated by adjustment screw 88 until the gaps between seam guide 22 and the edges 24 and 26 are eliminated or if gaps between the seam guide 22 and the edges 24 and 26 remains, until the gaps between the seam guide 22 and the edges 24 and 26 are substantially equal. This eliminates unequal forces from being applied to the edges of the metal strip 12 by the seam guide 22, which otherwise would gall or deform the edges.

Since a twist is removed by rollers 40 and 42 which rollingly engage the edges 24 and 26 of the metal strip 12, the deformation of one or the other of the edges is significantly reduced. Because the twist counteracting mechanism can be adjusted without stopping the mechanism for producing seam welded tubing, it further eliminates the need to shut down tube making process to correct for the twisting of the partially formed rolled metal strip due to imperfections.

It is not intended that the invention be limited to the specific embodiment shown in the drawings and discussed in the specification. It is recognized that those skilled in the art may make certain changes or improvements to the disclosed embodiment within the scope of the invention as set forth in the appended claims.

What is claimed:

1. A mechanism for counteracting a twist in a rolled metal strip being formed into tubing by a tube forming machine having a seam guide and a welder, the metal strip having a pair of parallel edges, said mechanism comprising:

a mounting bracket mountable to the tube forming machine;

a frame rotatably attached to said mounting bracket, said frame being rotatable about an axis concentric with an axis of said tubing being formed by said tube forming machine;

at least one pair of edge engaging rolls attached to said frame, each edge roll of said pair of edge engaging rolls rollingly engaging a respective one of the pair of parallel edges of the rolled metal strip;

at least one pair of backing rolls attached to said frame, said at least one pair of backing rolls engaging said rolled metal strip on a side opposite said pair of edge engaging rolls to prevent a transverse displacement of said rolled metal strip by said pair of edge engaging rolls; and means for rotating said frame to align the parallel edges of said rolled metal strip with the seam guide.

2. The mechanism of claim 1 wherein each roll of each pair of said at least one pair of edge engaging rolls is disposed 90° relative to the other.

3. The mechanism of claim 1 wherein said at least one pair of backing rolls comprises two pairs of backing rolls, one pair of said two pairs of backing rolls being disposed upstream of said pair of edge engaging rolls and the other pair of said two pairs of backing rolls being disposed downstream of said pair of edge engaging rolls.

4. The mechanism of claim 3 wherein each roll of each pair of said at least one pair of edge engaging rolls is disposed 90° relative to the other and each backing roll of each pair of said two pairs of backing rolls is disposed 90° relative to each other.

5. The mechanism of claim 3 wherein said two pairs of backing rolls are equally spaced on opposite sides of said at least one pair of edge rolls.

6. The mechanism of claim 1 wherein said frame comprises:

a first end member having a first through aperture;

a-second end member spatially separated from said first end member, said second end member having a second through aperture concentric with said first through aperture, said first and second through apertures receiving said rolled metal strip therethrough; and a bridge member rigidly connecting said first and second end members.

7. The mechanism of claim 6 wherein said first and second end members are substantially annular in shape.

8. The mechanism of claim 7 wherein said first and second end members have equal outside diameters, said bridge having an arcuate cross-section having a curvature mating with the outside diameters of said first and second end members.

9. The mechanism of claim 6 wherein one of said first and second end members has an annular boss concentric with said first and second through apertures and wherein said mounting bracket has a bore rotatably receiving said annular boss, said mechanism further comprising means for rotatably securing said annular boss in said bore.

10. The mechanism of claim 9 wherein said means for rotating said frame comprises:

a radially extending arm having one end connected to one of said first and second end members and a free end; and means connected between said free end and said mounting bracket for displacing said free end of said arm, said displacing said free end of said arm rotating said frame relative to mounting bracket.

11. A method for counteracting a twist in a rolled metal strip being formed into a tube by a tube forming machine, said tube forming machine having a seam guide for aligning the parallel edges of the metal strip with a seam welder, said method comprising the steps of:

disposing at least one pair of edge engaging rolls, mounted on a frame, between parallel edges of the rolled metal strip, each edge engaging roll being oriented to engage the rolled metal strip parallel to a respective one of said parallel edges; and rotating said frame about an axis concentric with the rolled metal strip to engage one of said pair of edge engaging rolls with said respective one edge to counteract a twist in the rolled metal strip and to align said parallel edges with said seam guide.

12. The method of claim 11 further comprising the step of supporting the rolled metal strip by at least one pair of backing rolls on a side opposite said pair of edge engaging rolls to inhibit a transverse displacement of the rolled metal strip by said pair of edge engaging rolls.

13. The method of claim 11 further comprising the step of supporting the rolled metal strip by two pairs of backing rolls disposed on a side of the rolled metal strip opposite said at least one pair of edge engaging rolls, one pair of said backing rolls being disposed upstream of said at least one pair of edge engaging rolls and the other pair of backing rolls being disposed downstream of said at least one pair of edge engaging rolls, said two pairs of backing rolls inhibiting the transverse displacement of said rolled metal strip by said pair of edge engaging rolls.

14. The method of claim 11 wherein said frame has a radially extending arm having a free end and an angle adjustment screw connecting said free end to a mounting bracket, said step of rotating said frame includes the step of rotating said angle adjustment screw in a direction to engage one of said edge engaging rolls with one of said parallel edges to remove a twist in said rolled metal strip and align said parallel edges with said seam guide.

15. A machine for forming tubing from a metal strip, said metal strip having a pair of longitudinal edges comprising:

at least one set of forming rolls forming said metal strip into a rolled tube;

a seam welder disposed downstream of said at least one set of forming rolls to weld a seam formed by said longitudinal edges to each other to produce a seam welded tube;

a seam guide disposed between said seam welder and said at least one set of forming rolls to align the longitudinal edges of the metal strip with said seam welder;

at least one pair of closing rolls disposed adjacent said seam welder to close said longitudinal edges to each other to form said seam; and a twist counteracting mechanism disposed between said seam guide and said at least one set of forming rolls, said twist counteracting mechanism having at least one pair of edge engaging rolls, each edge engaging roll of said at least one pair of edge engaging rolls engageable with a respective one of the longitudinal edges of the metal strip, said twist counteracting mechanism further including means for simultaneously rotating a pair of edge engaging roll about an axis concentric with the formed metal strip to remove a twist in said rolled tube and align said longitudinal edges with said seam guide.

16. The machine of claim 15 wherein said twist counteracting mechanism further comprises:

a rotatable frame to which said pair of edge engaging rolls are attached; said rotatable frame having a longitudinal axis of rotation; and means for rotatably supporting said rotatable frame between said at least one set of forming rolls and said seam guide with said longitudinal axis concentric with an axis of said rolled tube.

17. The machine of claim 16 wherein said twist counteracting mechanism further comprises at least one pair of backing rolls attached to said rotatable frame, said at least one pair of backing rolls engaging the side of said rolled tube opposite said edge engaging rolls to inhibit a transverse displacement of said rolled tube.

18. The machine of claim 17 wherein at least one pair of backing rolls comprises two pairs of backing rolls, one pair of said two pairs of backing rolls being disposed upstream of said pair of edge engaging rolls and the other pair of said two pairs of backing rolls being disposed downstream of said pair of edge engaging rolls.

19. The machine of claim 17 wherein one of said edge engaging rolls is disposed 90° relative to the other and each roll of said at least one pair of backing rolls is disposed substantially 90° to the other.

20. The machine of claim 16 wherein said means for rotating comprises:

an arm having one end attached to said rotatable frame and a free end; and an angle adjustment screw connecting said free end of said arm to said means for rotatably supporting, a rotation of said screw displacing said free end of said arm rotating said rotatable frame about said longitudinal axis.

* * * * *